US006664452B1

(12) United States Patent
Teel

(10) Patent No.: US 6,664,452 B1
(45) Date of Patent: Dec. 16, 2003

(54) ACOUSTIC GUITAR HAVING A COMPOSITE SOUNDBOARD

(75) Inventor: Timothy A. Teel, Lehighton, PA (US)

(73) Assignee: C. F. Martin & Company, Inc., Nazareth, PA (US)

( * ) Notice: Subject to any disclaimer, the term of this patent is extended or adjusted under 35 U.S.C. 154(b) by 0 days.

(21) Appl. No.: 10/262,129

(22) Filed: Oct. 1, 2002

(51) Int. Cl.[7] ..... B10D 3/00
(52) U.S. Cl. ..... 84/291; 84/290; 84/267
(58) Field of Search ..... 84/291, 275, 290, 84/267, 274

(56) References Cited

U.S. PATENT DOCUMENTS

| | | | | |
|---|---|---|---|---|
| 4,188,850 A | | 2/1980 | Kaman, II | 84/291 |
| 4,408,516 A | | 10/1983 | John | 84/275 |
| 4,836,076 A | | 6/1989 | Bernier | 84/275 |
| 4,873,907 A | | 10/1989 | Decker, Jr. et al. | 84/291 |
| 4,969,381 A | | 11/1990 | Decker, Jr. et al. | 84/291 |
| 5,333,527 A | | 8/1994 | Janes | 84/291 |
| 5,406,874 A | * | 4/1995 | Witchel | 84/291 |
| 5,461,958 A | | 10/1995 | Dresdner et al. | 84/267 |
| 5,952,592 A | | 9/1999 | Teel | 84/291 |
| 6,034,309 A | | 3/2000 | Teel et al. | 84/291 |
| 6,107,552 A | | 8/2000 | Coomar et al. | 84/291 |
| 6,294,718 B1 | * | 9/2001 | Saunders et al. | 84/291 |
| 6,420,638 B2 | | 7/2002 | Teel | 84/293 |
| 2002/0088330 A1 | | 7/2002 | Teel | 84/291 |

OTHER PUBLICATIONS

Loctite, Laboratory Data Sheet Product 3414, Dec. 2000.
Loctite, Product Description Sheet Hysol® Product 9433, Aug. 2001.

* cited by examiner

*Primary Examiner*—Kimberly Lockett
(74) *Attorney, Agent, or Firm*—Howson and Howson

(57) ABSTRACT

An acoustic guitar having a hollow body constructed with a pre-finished graphite soundboard and a pre-finished high pressure laminate backboard and sidewall. The graphite soundboard provides the acoustic guitar with a unique appearance and enhances durability without adversely affecting the tonal qualities of the guitar. A bracing pattern particularly for use with the graphite soundboard is also provided.

20 Claims, 3 Drawing Sheets

ACOUSTIC GUITAR HAVING A COMPOSITE SOUNDBOARD

FIELD OF THE INVENTION

The present invention relates to stringed musical instruments, such as, acoustic guitars, and more particularly, the present invention relates to a novel acoustic guitar assembly which includes a soundboard made of composite materials.

BACKGROUND OF THE INVENTION

A typical acoustic guitar has a hollow body connected to a neck. The hollow body has a soundboard with a soundhole, a backboard spaced from the soundboard, and a shaped sidewall which extends between the soundboard and backboard. Typically, these components are constructed of choice pieces of wood.

Prior art designs have attempted to improve upon the strength and durability of acoustic guitars without adversely affecting the playing qualities of the guitar. For example, U.S. Pat. No. 5,461,958 which issued to Dresdner et al. and which is assigned to C.F. Martin & Company, Inc., the assignee of the present application, discloses an acoustic guitar assembly having a wooden soundboard with an improved soundboard bracing structure and an improved neck to body joint.

Acoustic guitar bodies have also been manufactured from high pressure laminate materials. For example, U.S. Pat. No. 5,406,874 issued to Witchel and assigned to C.F. Martin & Company, Inc. discloses a sidewall, soundboard and baseboard of a hollow body of an acoustic guitar constructed of sheets of synthetic resin laminates, such as, melamine impregnated resins impressed over phenolic kraft layers.

U.S. Pat. Nos. 5,952,592, 6,034,309 and 6,420,638 issued to Teel and assigned to C.F. Martin & Company, Inc. provide additional examples of an acoustic guitar body made of high pressure laminate materials. The '592 patent discloses a unique bracing pattern specifically for use on the underside of a soundboard made of high pressure laminate materials. The '309 patent discloses a method of manufacturing a guitar body made of high pressure laminate materials, and the '638 patent discloses a guitar neck made of plywood impregnated with a phenolic resin and a fingerboard and/or guitar bridge made of a high pressure laminate material. In addition, co-pending U.S. patent application Ser. No. 09/862,273 filed on May 22, 2001 discloses a soundboard and/or headplate made of metal, such as aluminum. The above referenced acoustic guitars assembled from unconventional materials provide an economic alternative for purchasers of high quality acoustic guitars, and due to dwindling wood resources, provide an ecologically-friendly alternative to traditional solid and laminated tonewoods.

Another material utilized to construct components of acoustic guitars is graphite, or carbon, fibers. For example, U.S. Pat. No. 5,333,527 issued to Janes et al. discloses an acoustic guitar constructed with a compression molded composite soundboard made of multiple layers of epoxy impregnated graphite fibers formed of about 33% by volume of resin and about 67% by volume of graphite fiber. The uppermost and lowermost layers of the composite soundboard are a woven graphite fiber fabric, and the inner layers are laminates in which the graphite fibers are unidirectionally-oriented. For instance, the direction of the fibers in some of the laminates are oriented such that they extend parallel to the strings of the instrument, while the direction of fibers in other of the laminates extend perpendicular to the strings of the instrument.

Other stringed musical instruments have also been constructed from graphite, or carbon, fibers and are disclosed, for example, in U.S. Pat. Nos: 4,408,516 issued to John; 4,873,907 and 4,969,381 issued to Decker, Jr. et al.; 6,107,552 issued to Coomar et al.; and 6,294,718 issued to Saunders, Jr. et al. The John patent discloses a violin made from a plurality of sheets of unidirectional graphite fibers impregnated with an epoxy resin in which the resin forms 40% by volume and fibers form 60% by volume. The direction of the fibers of some of the layers are oriented parallel to the strings of the instrument while the direction of the fibers in other of the layers are oriented perpendicular to the strings and at a 45° angle relative to the strings. The Decker patents disclose an acoustic guitar having a composite soundboard made of a lay-up of woven polymer fabric, preferably an aramid fabric, and a layer of unidirectional graphite fibers followed by a layer of decorative fabric, such as silk, which are all embedded in a resin matrix. The Coomar and Saunders patents disclose soundboards including a wooden or foam core material sandwiched between layers of a graphite sheet material embedded in an epoxy resin.

Also see U.S. Pat. No. 4,429,608 issued to Kaman et al. which discloses a one layer molded plastic soundboard made of 40% glass fibers and 60% resin with the fibers being randomly oriented, and U.S. Pat. No. 4,836,076 issued to Bernier which discloses a molded violin having a soundboard made of resin, fiberglass and/or fiber plastic.

Although the above-mentioned stringed musical instruments accomplish their intended purposes, there is a need for a high quality, durable acoustic guitar which is constructed from relatively inexpensive unconventional materials, particularly laminate materials, which provide both a unique decorative appearance and superior acoustic qualities. In particular, the hollow body of the acoustic guitar should have a composite graphite soundboard and a high pressure laminate sidewall and backboard. In addition, the underside of the soundboard should include bracing that provides the acoustic guitar with the necessary durability as well as with desired tonal and playing qualities.

OBJECTS OF THE INVENTION

With the foregoing in mind, a primary object of the present invention is to provide a high quality acoustic guitar which can be manufactured economically relative to traditional all wooden acoustic guitar models.

Another object of the present invention is to provide an acoustic guitar having a uniquely braced graphite soundboard which does not adversely affect the tonal qualities of the guitar.

SUMMARY OF THE INVENTION

More specifically, the present invention provides an acoustic guitar having a hollow body and an elongate neck extending from said hollow body. The hollow body has a composite soundboard with a substantially planar underside and a soundhole. The composite soundboard is constructed from laminate sheet material made of multiple layers of epoxy impregnated graphite fibers. Preferably, the graphite fibers within each layer are unidirectionally-oriented within each layer such that at least some of the layers of the laminate sheet material extend parallel to the strings of the acoustic guitar.

The composite soundboard of the present invention preferably has bracing made of spruce adhesively secured to, and depending from, the underside of the composite soundboard. The bracing includes an X-shaped cross brace and an A-frame brace. The cross brace has four legs defining four quadrants on the soundboard, and a pair of the legs define a first quadrant in which the soundhole is located and the other pair of legs define an opposite quadrant on the soundboard remote from the guitar neck. The A-frame brace is located in the first quadrant between the soundhole and the guitar neck and cooperates with the cross brace to completely surround and reinforce the soundhole. The bracing is preferably secured to the underside of the soundboard with an acrylic adhesive that cures at room temperature or an epoxy adhesive that cures at room temperature.

The hollow body of the acoustic guitar has a backboard spaced from the graphite soundboard and a sidewall extending between and connecting the graphite soundboard and backboard. The backboard and sidewall are each constructed of a pre-finished high pressure laminate material. Preferably, the pre-finished laminate material utilized to make the sidewall and backboard is sheets of synthetic resin laminates, such as, melamine impregnated resins impressed over phenolic kraft layers.

BRIEF DESCRIPTION OF THE DRAWINGS

The foregoing and other objects, features and advantages of the present invention should become apparent from the following description when taken in conjunction with the accompanying drawings, in which.

DETAILED DESCRIPTION OF THE PREFERRED EMBODIMENT

Figure 1:
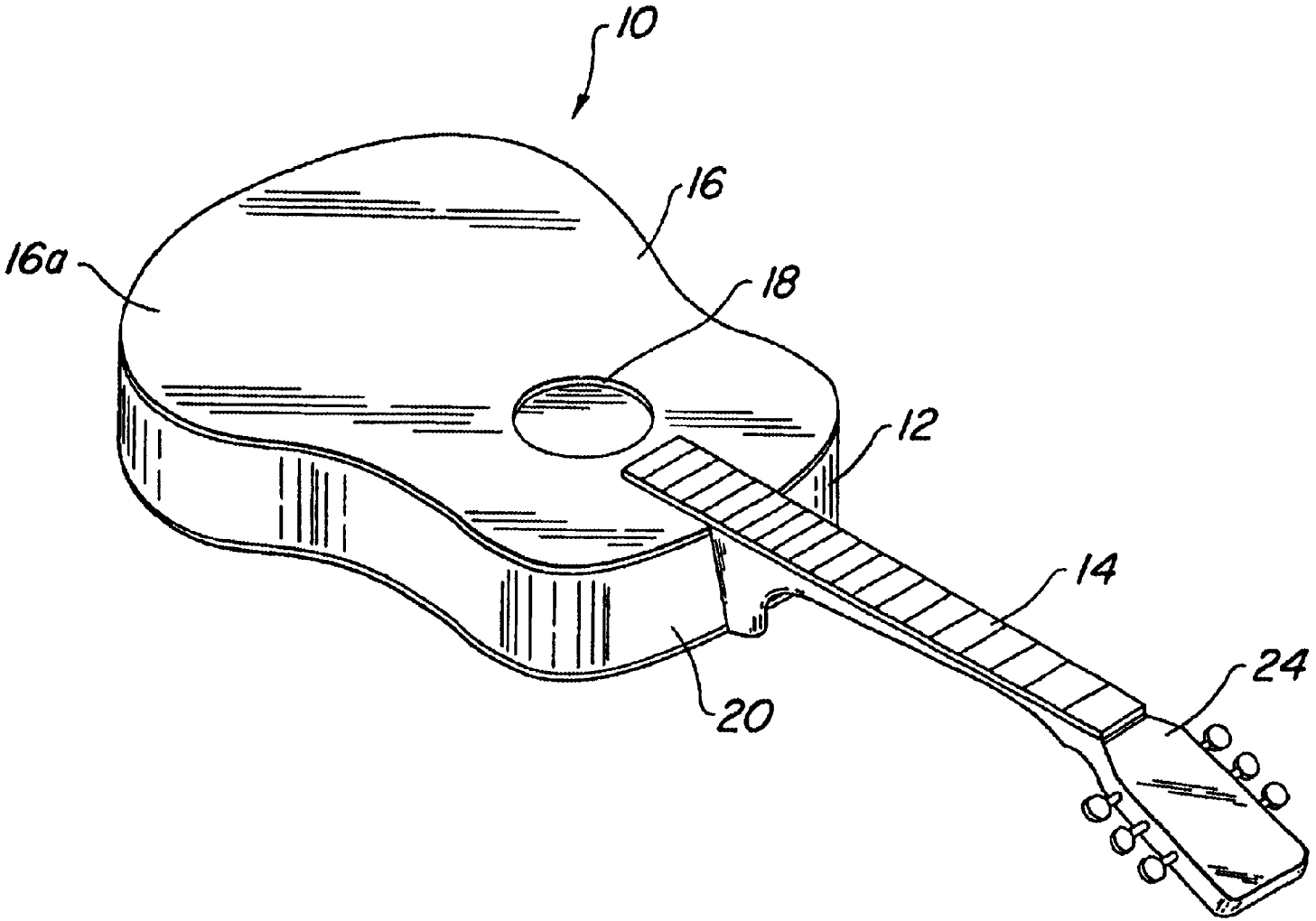
FIG. 1 is a perspective view of an acoustic guitar according to the present invention.

Referring now to the drawings, FIG. 1 illustrates an acoustic guitar 10 having a hollow body 12 and a neck 14. The body has a soundboard 16 with a circular soundhole 18. The soundboard 16 is connected to sidewall 20 which, in turn, is connected to a backboard 22. The neck 14 has a headstock 24, and strings (not shown) are strung from the headstock 24 in a direction along the neck 14, across the soundhole 18 and to a bridge (not shown) on the outer side 16*a* of the soundboard 16.

One of the novel aspects of the present invention is that the soundboard 16 of the hollow body 12 is made of a pre-finished composite laminate material instead of a more conventional material, such as spruce. More specifically, the soundboard 16 is made of a planar sheet including multiple layers of epoxy impregnated graphite fibers. The graphite fibers form the majority of the material utilized to make the soundboard 16, and thus, the soundboard 16 is referred to herein as a graphite soundboard. An example of a graphite soundboard is disclosed by U.S. Pat. No. 5,333,527 issued to Janes et al., the disclosure of which is incorporated herein by reference. Each layer, for instance, can be made from about 67% by volume of graphite fibers and about 33% resin, and if desired, a woven graphite fiber fabric can be used to form the outer layers of the soundboard 16.

Figure 4:
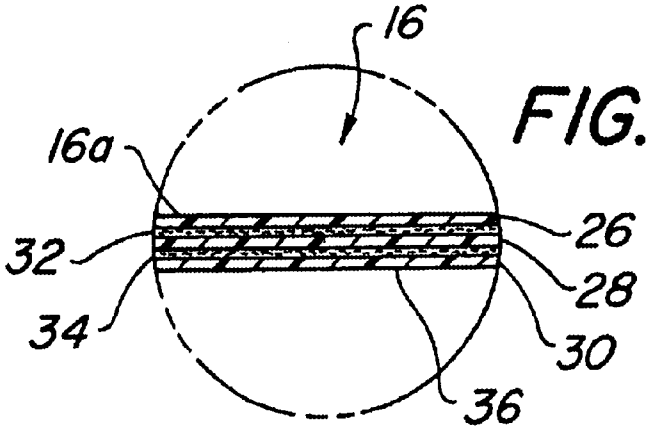
FIG. 4 is a blown-up cross-sectional view of the composite graphite soundboard illustrated in FIG. 3.

Preferably, the graphite fibers are unidirectionally-oriented in each layer of the laminate soundboard material. The orientation of the fibers provides the needed structural strength required of the soundboard 16 while permitting the soundboard 16 to be sufficiently flexible so that the acoustic guitar 10 produces the desired tonal qualities. Preferably, the fibers in at least some of the layers are oriented in a direction parallel to the strings, while the fibers in other of the layers are oriented in a direction perpendicular of the strings. For instance, layers 26, 28 and 30 illustrated in FIG. 4 contain fibers extending only parallel to the strings, and layers 32 and 34 contain fibers extending only perpendicular to the strings. The number and pattern of layers in the lay-up of the laminate can be modified, for instance, as disclosed by the Janes et al. patent. One alternative is for each layer in the laminate, or at least the majority of layers in the laminate, to contain fibers oriented parallel to the strings.

An acoustic guitar 10 constructed with the graphite soundboard 16 provides both material and labor cost advantages. The graphite material is more available and less expensive than more conventional wooden materials, and the graphite soundboard is provided in a pre-finished condition requiring little, if any, finishing steps after assembly of the hollow body 12 of the acoustic guitar 10. In addition, the graphite soundboard 16 is provided in sheet form having an outer surface 16*a* with any desired pre-finished decorative appearance.

The use of a graphite soundboard 16 does not, by itself, produce a durable acoustic guitar that provides a high quality sounding musical instrument. Thus, an important aspect of the present invention is the shape of the soundboard and the use of bracing. The shape of the soundboard effects the flexibility, rigidity and acoustics of the acoustic guitar, and the bracing provides a reinforcement function. Bracing is typically required since tension created by the strings of an acoustic guitar can cause damage to the soundboard, particularly in a region adjacent the soundhole. In addition, if the soundboard is permitted to "lift up" or "belly", then the increased height of the strings above the neck makes the acoustic guitar difficult to play. Although the bracing must prevent "bellying", it should not over-stiffen the soundboard 16 and deaden the acoustics of the guitar 10. Thus, the bracing must permit the soundboard to have a sufficient amount of flexure to enable the acoustic guitar to produce a desired tonal quality.

To accomplish the above referenced goals, the graphite soundboard 16 according to the present invention is planar and does not have any grooves, integrally formed ribs, waves or the like, and the underside 36 of the graphite soundboard 16 has a set of adhesively-secured, separately-manufactured, wooden bracing in a specified pattern. To this end, the bracing includes a cross brace, or X-brace, 38 and an A-frame brace 40. In addition, preferably the graphite soundboard 16 has a thickness within a range of 0.045 inch to 0.065 inch.

Figure 2:
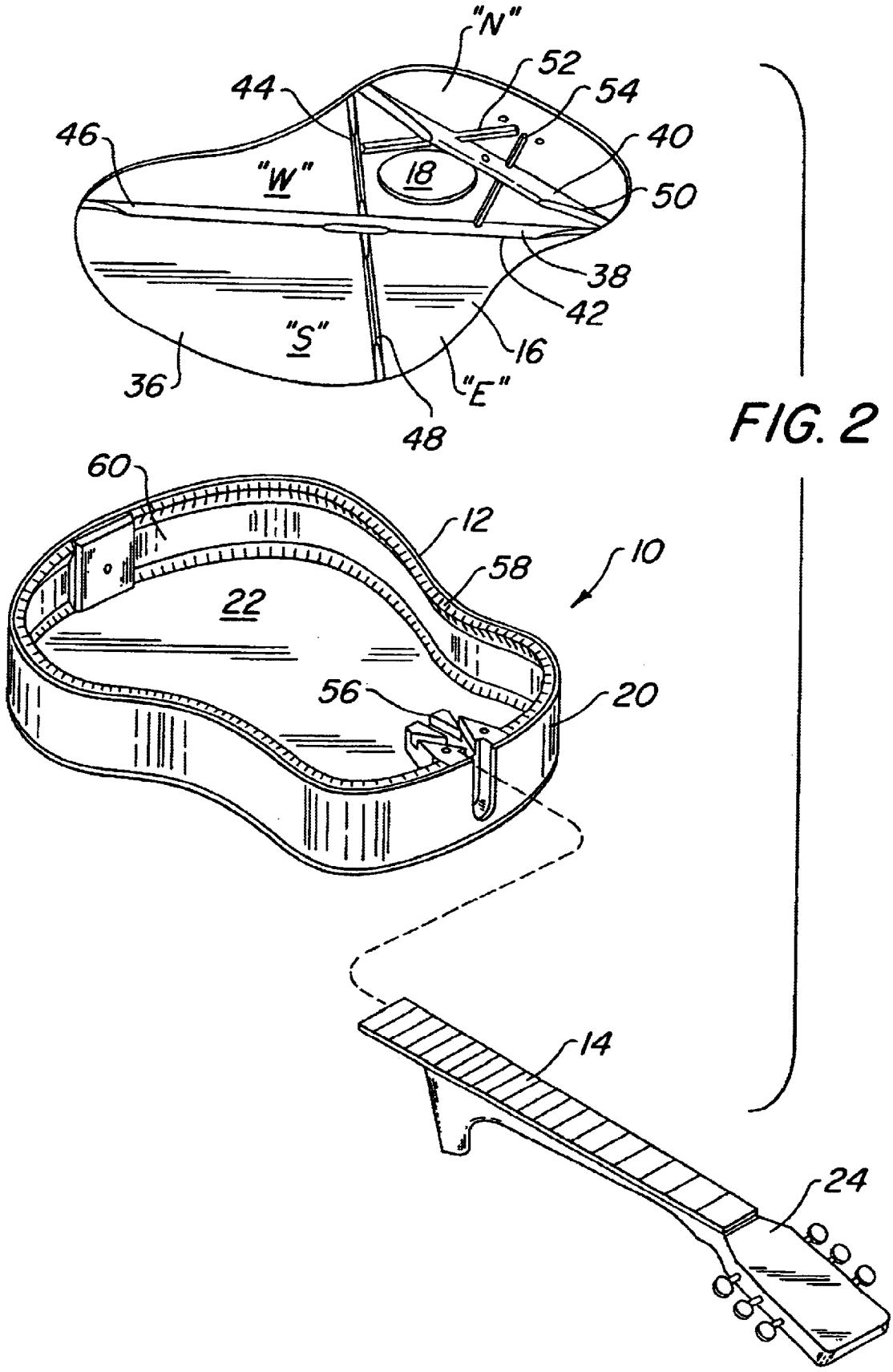
FIG. 2 is an exploded view of the acoustic guitar illustrated in FIG. 1.
Figure 3:
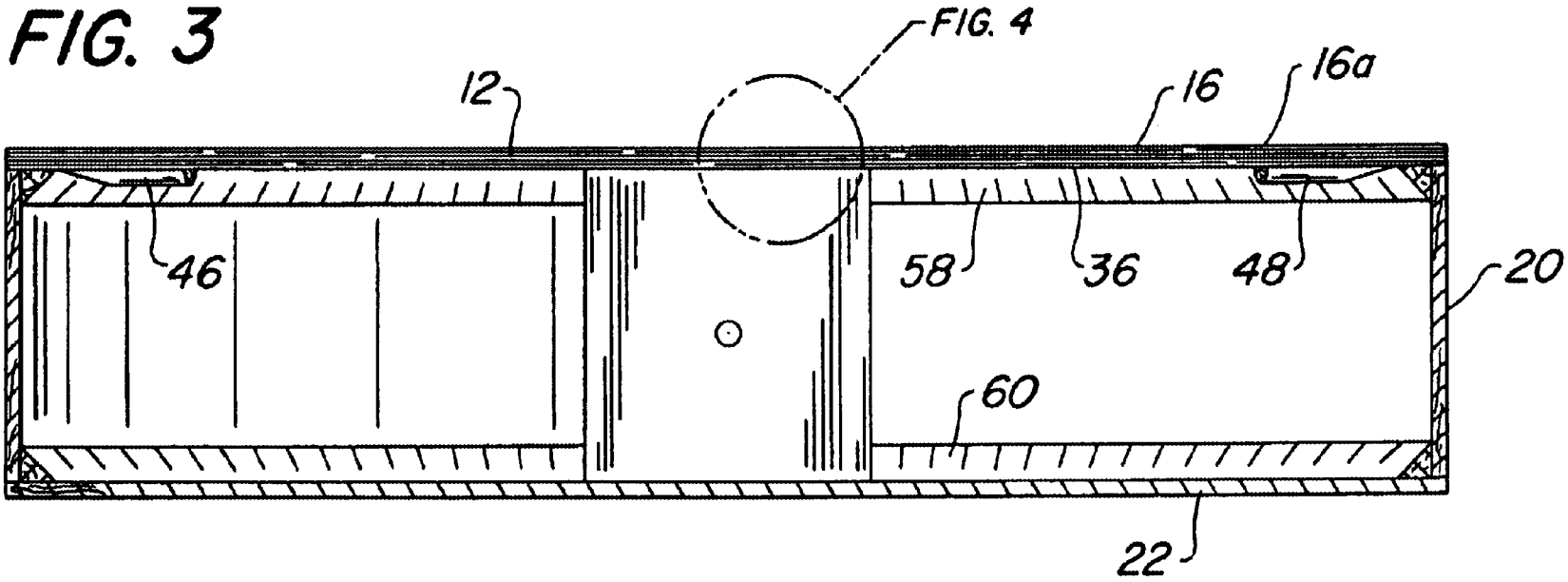
FIG. 3 is a cross-sectional view of the hollow body of the acoustic illustrated in FIG. 1.

The X-brace 38 and the A-frame brace 40 are provided to completely encompass the soundhole 18 and support the area of the graphite soundboard 16 adjacent the soundhole 18. This support prevents extreme bending of the graphite soundboard 16 between the soundhole 18 and the outer peripheral edge of the acoustic guitar 10. As best illustrated in FIG. 2, the X-brace 38 extends across a substantial portion of the underside 36 of the graphite soundboard 16 and has four upstanding legs, 42, 44, 46 and 48. The legs 42 and 44 of the X-brace 38 define a first, or northernmost, quadrant "N", and the legs 46 and 48 define an opposite, or southernmost, quadrant "S". Side quadrants, "E" and "W", are defined by legs 42 and 48 and legs 44 and 46, respectively. The soundhole 18 is located within the northern quadrant "N" and is structurally supported by legs 42 and 44 of the X-brace 38. The area of the graphite soundboard 16 furthest from the neck 14 is supported by legs 46 and 48 of the X-brace 38.

The A-frame brace 40 extends in the northern quadrant "N" across the portion of the graphite soundboard 16 between the legs 42 and 44 of the X-brace 38 and the neck 14. The A-frame brace 40 has three legs 50, 52 and 54 which structurally support the area of the soundboard adjacent the soundhole 18 and neck 14. The leg 50 extends transversely of the graphite soundboard 16 and neck 14 between the soundhole 18 and neck 14. The transverse leg 50 is notched to secure the legs 52 and 54 to the underside 36 of the graphite soundboard 16. The A-frame brace 40 also provides structural support for the neck to hollow body joint.

Preferably, the cross brace 38 and the A-frame brace 40 are the only bracing utilized on the graphite soundboard 16 so that the soundboard provides the desired tonal qualities. Thus, the conventional use of bracing including a bridge plate, tone bars and/or other support panels or elements are specifically not utilized according to the present invention. See U.S. Pat. No. 5,952,592 for an example of acoustic guitar soundboard bracing including a bridge plate, tone bars and side support panels. In addition, preferably the braces 38 and 40 on the graphite soundboard 16 are tapered along their lengthwise edges and/or are scalloped, and preferably the braces 38 and 40 are made of spruce.

According to the present invention, preferably an acrylic adhesive that cures at room temperature, or an epoxy adhesive that cures at room temperature, is utilized to secure the bracing 38 and 40 to the underside 36 of the graphite soundboard 16 and to secure the peripheral edge of the graphite soundboard 36 to the sidewall 20 of the hollow body 12 of the acoustic guitar 10. By way of example, and not by way of limitation, preferred adhesives include LOCTITE acrylic adhesive product number 3414 or LOCTITE HYSOL epoxy adhesive product number 9433 marketed by Loctite Corporation of Rocky Hill, Conn.

Another important aspect of the present invention is that the sidewall 20 and backboard 22 of the hollow body 12 are constructed of a pre-finished high pressure laminate material that is also more available and less expensive than more conventional wooden materials and that is also provided in a pre-finished condition requiring little, if any, finishing steps after the hollow body 12 is assembled. To this end, the sidewall 20 and backboard 22 are constructed of sheets of synthetic resin laminates, preferably, melamine impregnated resins impressed over phenolic craft layers. U.S. Pat. No. 5,406,874 issued to Witchel discloses such material and its disclosure is incorporated herein by reference.

The hollow body 12 is assembled by gluing the graphite soundboard 16 and high pressure laminate backboard 22 to the high pressure laminate sidewall 20 with an adhesive. As illustrated in FIG. 2, the hollow body 12 preferably also includes an adhesively secured frontblock 56 to which the neck 14 is connected, and ribbon linings 58 and 60 which are adhesively secured to the sidewall 20 adjacent the longitudinal edges of the sidewall 20. The above described structural features facilitate ready manufacture and provide a durable, uniquely decorated acoustic guitar which is inexpensive to manufacture and provides excellent tonal qualitites and playability.

While a preferred embodiment of an acoustic guitar has been described, various modifications, alterations, and changes may be made without departing from the spirit and scope of the present invention as defined in the appended claims.

What is claimed is:

1. An acoustic guitar, comprising:

a hollow body and an elongate neck extending from said hollow body;

said hollow body having a composite soundboard with a substantially planar underside and a soundhole extending therethrough, said composite soundboard being a laminate sheet material made of multiple layers of epoxy impregnated graphite fibers, said graphite fibers being unidirectionally-oriented within each layer;

said composite soundboard having wooden bracing adhesively secured to and depending from said underside of said composite soundboard;

said wooden bracing including an X-shaped cross brace with four legs defining four quadrants on said soundboard, a pair of said legs define a first quadrant in which said soundhole is located, and the other pair of said legs define an opposite quadrant on the soundboard remote from said neck; and said wooden bracing including an A-frame brace located in said first quadrant on said soundboard between said soundhole and said neck, said A-frame brace cooperating with said cross brace to completely surround and reinforce said soundhole.

2. An acoustic guitar according to claim 1, wherein said wooden bracing is made of spruce and consists only of said cross brace and said A-frame brace.

3. An acoustic guitar according to claim 2, wherein said wooden bracing is adhesively secured with an acrylic adhesive that cures at room temperature.

4. An acoustic guitar according to claim 2, wherein said wooden bracing is adhesively secured with an epoxy adhesive that cures at room temperature.

5. An acoustic guitar according to claim 1, wherein said hollow body has a backboard spaced from the soundboard and a sidewall extending between and connecting said soundboard and backboard, and wherein said backboard and sidewall are each constructed of a pre-finished high pressure laminate material.

6. An acoustic guitar according to claim 5, wherein said pre-finished high pressure laminate material utilized to make said backboard and sidewall is provided by a sheet of synthetic resin laminates.

7. An acoustic guitar according to claim 6, wherein said synthetic resin laminates are made of melamine impregnated resins impressed over phenolic kraft layers.

8. An acoustic guitar according to claim 1, wherein said acoustic guitar has stings extending parallel to said elongate neck, and wherein said unidirectionally-oriented graphite fibers in at least some of said layers of said laminate sheet material of said composite soundboard extend parallel to said strings.

9. An acoustic guitar according to claim 8, wherein said unidirectionally-oriented graphite fibers in at least some of said layers of said laminate sheet material of said composite soundboard extend perpendicular to said strings.

10. An acoustic guitar according to claim 8, wherein said unidirectionally-oriented graphite fibers in all of said layers of said laminate sheet material of said composite soundboard extend parallel to said strings.

11. An acoustic guitar according to claim 8, wherein said soundboard has a thickness of about 0.045 inch to about 0.065 inch.

12. An acoustic guitar, comprising:

a hollow body and an elongate neck extending from said hollow body;

said hollow body having a composite soundboard with a substantially planar underside and a soundhole extending therethrough;

said composite soundboard being a laminate sheet material made of multiple layers of epoxy impregnated graphite fibers, said graphite fibers being unidirectionally-oriented within each layer; and said hollow body having a backboard spaced from the soundboard and a sidewall extending between and connecting said soundboard and backboard, each of said backboard and sidewall being constructed of a pre-finished high pressure laminate material.

13. An acoustic guitar according to claim 12, wherein said pre-finished high pressure laminate material utilized to make said sidewall and backboard is a sheet of synthetic resin laminates.

14. An acoustic guitar according to claim 13, wherein said synthetic resin laminates are made of melamine impregnated resins impressed over phenolic kraft layers.

15. An acoustic guitar according to claim 12, wherein wooden bracing is adhesively secured to and depends from said substantially planar underside of said composite soundboard.

16. An acoustic guitar according to claim 15, wherein said wooden bracing includes an X-brace having four legs defining four quadrants on said soundboard, a pair of said X-brace legs define a first quadrant in which said soundhole is located, and the other pair of said X-brace legs define an opposite quadrant on the soundboard remote from said neck; and wherein said wooden bracing includes an A-brace located in said first quadrant on said soundboard between said soundhole and said neck, said A-brace cooperating with said X-brace to completely surround and reinforce said soundhole.

17. An acoustic guitar according to claim 16, wherein said bracing is adhesively secured with one of an acrylic adhesive that cures at room temperature and an epoxy adhesive that cures at room temperature.

18. An acoustic guitar according to claim 17, wherein said wooden bracing is made of spruce and wherein said X-brace and A-brace are the only bracing provided on said underside of said composite soundboard.

19. An acoustic guitar according to claim 12, wherein said acoustic guitar has stings extending parallel to said elongate neck, and wherein said unidirectionally-oriented graphite fibers in at least some of said layers of said laminate sheet material of said composite soundboard extend parallel to said strings.

20. An acoustic guitar according to claim 19, wherein said unidirectionally-oriented graphite fibers in at least some of said layers of said laminate sheet material of said composite soundboard extend perpendicular to said strings.

* * * * *